US005335397A

United States Patent [19]

Stahlecker

[11] Patent Number: 5,335,397

[45] Date of Patent: Aug. 9, 1994

[54] TWO-APRON DRAFTING UNIT FOR SPINNING MACHINES

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 76,782

[22] Filed: Jun. 15, 1993

[30] Foreign Application Priority Data

Jun. 27, 1992 [DE] Fed. Rep. of Germany ..... 4221154

[51] Int. Cl.[5] ..... D01H 5/86

[52] U.S. Cl. ..... 19/255; 19/254; 19/244

[58] Field of Search ..... 19/252, 253, 254, 255, 19/236, 244, 248, 249; 474/238, 246; 198/626.2, 626.3, 806, 817

[56] References Cited

U.S. PATENT DOCUMENTS

| | | | |
|---|---|---|---|
| 2,899,714 | 8/1959 | Noguera | 19/255 |
| 2,941,262 | 6/1960 | Schiltknecht | 19/254 |
| 3,235,914 | 2/1966 | Ihei Beppu | 19/255 |
| 3,665,559 | 5/1972 | Ooki | 19/254 |
| 3,890,677 | 6/1975 | Noguera | 19/255 |

FOREIGN PATENT DOCUMENTS

| | | | |
|---|---|---|---|
| 1201735 | 9/1965 | Fed. Rep. of Germany . | |
| 7721239 | 12/1978 | Fed. Rep. of Germany . | |
| 524886 | 8/1940 | United Kingdom | 19/255 |
| 745127 | 2/1956 | United Kingdom | 19/255 |

*Primary Examiner*—Clifford D. Crowder
*Assistant Examiner*—John J. Calvert
*Attorney, Agent, or Firm*—Evenson, McKeown, Edwards & Lenahan

[57] ABSTRACT

In the case of a two-apron drafting unit for spinning machines, it is provided for the parallel alignment of the top apron cradle and of the pressure roller twin guided by it with respect to the pertaining bottom cylinder that the pressure roller holder arranged in the load carrier only takes over the function of providing the load and the lateral guiding. The parallel alignment of the apron cradle is caused by a preferably L-shaped stop against which the apron cradle will be placed. The shaft of the pressure roller twin is unguided in the radial direction in the pressure roller holder.

26 Claims, 9 Drawing Sheets

TWO-APRON DRAFTING UNIT FOR SPINNING MACHINES

BACKGROUND AND SUMMARY OF THE INVENTION

This invention relates to a two-apron drafting unit for spinning machines comprising drivable bottom cylinders and pressure roller twins which are pressed against these bottom cylinders. The respective pressure roller twins are arranged with one shaft in the center of a pressure roller holder of at least one apron is guided by an apron cradle which, together with a load carrier, can be swivelled away from the assigned bottom cylinder. The apron cradle is provided with upper deflecting guides for the top aprons and, during the operation, is positioned by means of contact pressure, as a result of a spring force against at least two stops which are aligned with lower deflecting guides for bottom aprons which are arranged in parallel to the bottom cylinder. The first stop is used for determining the distance of the upper deflection guides with respect to the lower deflection guides, and the second stop is used for the parallel alignment of the upper deflection guides and of the pressure roller twin with respect to the lower deflection guides.

In the case of pressure roller twins and apron cradles, it is relatively difficult to ensure the parallel position of the apron cradles and of the pressure roller twins with respect to the bottom cylinders during the operation. There is the risk that, after an opening and closing of the drafting unit, the apron cradles each time take a changed position. For this reason, in the case of the known two-apron drafting units (German Utility Model 77 21 239 as well as U.S. Pat. No. 3,665,559), stops are provided for the parallel alignment of the apron cradles against which the apron cradles are placed without play under the effect of a spring when the drafting unit is closed. However, since normally the pressure roller holder, which is arranged in the load carrier and against which the loading spring is pressed, guides the shaft of the pertaining pressure roller twin virtually without play between guiding surfaces, it is necessary in the case of the state of the art to dispose the pressure roller holder as a whole to be displaceable against the stop in order to avoid redundancies. This is disadvantageous in that not only the shaft of the pressure roller twin guided by the apron cradle but, in addition, also the whole pressure roller holder must be aligned with respect to the apron cradle. In this case, the increased mass forces and friction forces counteract the endeavored goal.

It is also known (German Published Application 12 01 735) to load the apron cradle directly by means of the loading spring and to let a portion of the loading force act upon the shaft of the pressure roller twin. At the same time, the apron cradle is pressed against the lower deflection guide of the bottom apron in a spring-actuated manner. The parallel alignment should take place as a result of the fact that the shaft of the pressure roller twin is guided in a precisely axially parallel manner with respect to the pertaining bottom cylinder in the slot guides of the pressure roller holder. Because of the very narrow guiding base of the pressure roller holder, however, a sufficient parallel alignment is not possible.

In an older German Patent Application (DE 42 15 004.3), which is no prior publication, it was suggested to use a common apron cradle for the top apron and the bottom apron and to place it in a swivellable manner on the bottom cylinder. In this case, the apron cradle is supported against a stop so that the pressure roller twin is aligned in parallel to the bottom cylinder by means of the apron cradle. In contrast to this suggestion, the novelty of the object of the application is the fact that deflection guides are provided for the bottom aprons which are independent of the bottom cylinder.

It is an object of the invention to permit, in the case of a two-apron drafting unit of the initially mentioned type, a good parallel alignment of the upper deflection guides and of the pertaining pressure roller twin with respect to the bottom cylinders without the requirement of also aligning the pressure roller holder by means of the apron cradle.

This object is achieved in that the shaft of the pressure roller twin is unguided in the pressure roller holder in the radial direction.

As a result of the characteristics of the invention, the pressure roller holder essentially only receives the function of providing the load as well as, if required, the lateral guiding, while the parallel alignment of the apron cradle and of the pressure roller twin is determined by at least one stop, against which the apron cradle is placed under the effect of a spring without any clearance and, in the process, will guide the pressure roller twin. The pressure roller holder itself will not go along in these movements against the stop. As a result, in comparison to the state of the art, the mass forces and friction forces are reduced significantly so that the precision of the parallel alignment is increased. By means of the apron cradle, which reaches around the shaft, the pressure roller twin is also pressed against the assigned bottom cylinder without any play.

In a development of the invention, it is provided that the spring-loaded pressure roller holder or its loading spring is applied directly to the apron cradle by means of a force introducing surface which generates a force component against both stops. Deviating from the state of the art, the loading force is not transmitted directly by the pressure roller holder to the shaft of the pressure roller twin, but the pressure roller holder first loads the apron cradle which transmits its load to the shaft. In this case, a component of this load acts directly against the stops. In this manner, as few masses as possible have to be moved.

However, as an alternative, the pressure roller holder or its loading spring may also be applied directly to the shaft of the pressure roller twin by means of a sliding surface which permits radial movements of the shaft.

Expediently, the pressure roller holder is provided with guiding surfaces which guide the apron cradle laterally. They limit the mobility of the apron cradle in the lateral direction.

In a particularly advantageous development of the invention, it is provided that at least two stops each have a stop face, the two stop faces changing into one another in an approximately L-shaped manner. This has the advantage that the upper deflection guides can virtually simultaneously be placed against both stops. The L-shaped profile of the stop faces ensures that the spacing of the upper deflection guides with respect to the lower deflection guides may possibly take place by means of a single component.

Expediently, a sliding surface is assigned to the stop faces which leads the apron cradle to the stops. As a result, it is ensured that, when the drafting unit is closed, the apron cradle automatically finds its operating position.

Expediently, at least one of the stops is exchangeably mounted on the assigned lower deflection guide which is preferably constructed as a reversing rail. As a result, the drafting unit can be adapted to different fiber materials to be spun. For example, by means of this measure, the distance of the upper deflection guide to the pertaining lower deflection guide, the so-called opening width, can be adjusted. This distance of the forward deflection of the apron pairs with respect to the nip line of the roller pair that follows can also be adjusted in this manner.

Advantageously, the lower deflection guides can be adjusted with respect to their position relative to the drafting zone plane of the drafting unit. It therefore becomes possible not only to adjust the desired opening width, but also to carry out this adjustment symmetrically with respect to the drafting zone plane.

In an advantageous development of the invention, the second stop, which is used for the parallel alignment, comprises two partial stops whose distance from one another corresponds approximately to the distance of the top aprons pertaining to a pressure roller twin. As a result, a very wide guiding base of those stops is achieved which take over the parallel alignment. The larger the guiding base, the more exactly the pressure roller twins can be aligned with respect to the pertaining bottom cylinder.

In a further development of the invention, a holding device is assigned to the second stop which holds a sliver guide. Consequently, the so-called condenser can also be adjusted precisely with respect to the apron cradle and the roller pair which follows.

Other objects, advantages and novel features of the present invention will become apparent from the following detailed description of the invention when considered in conjunction with the accompanying drawings.

DETAILED DESCRIPTION OF THE DRAWINGS

Figure 1:
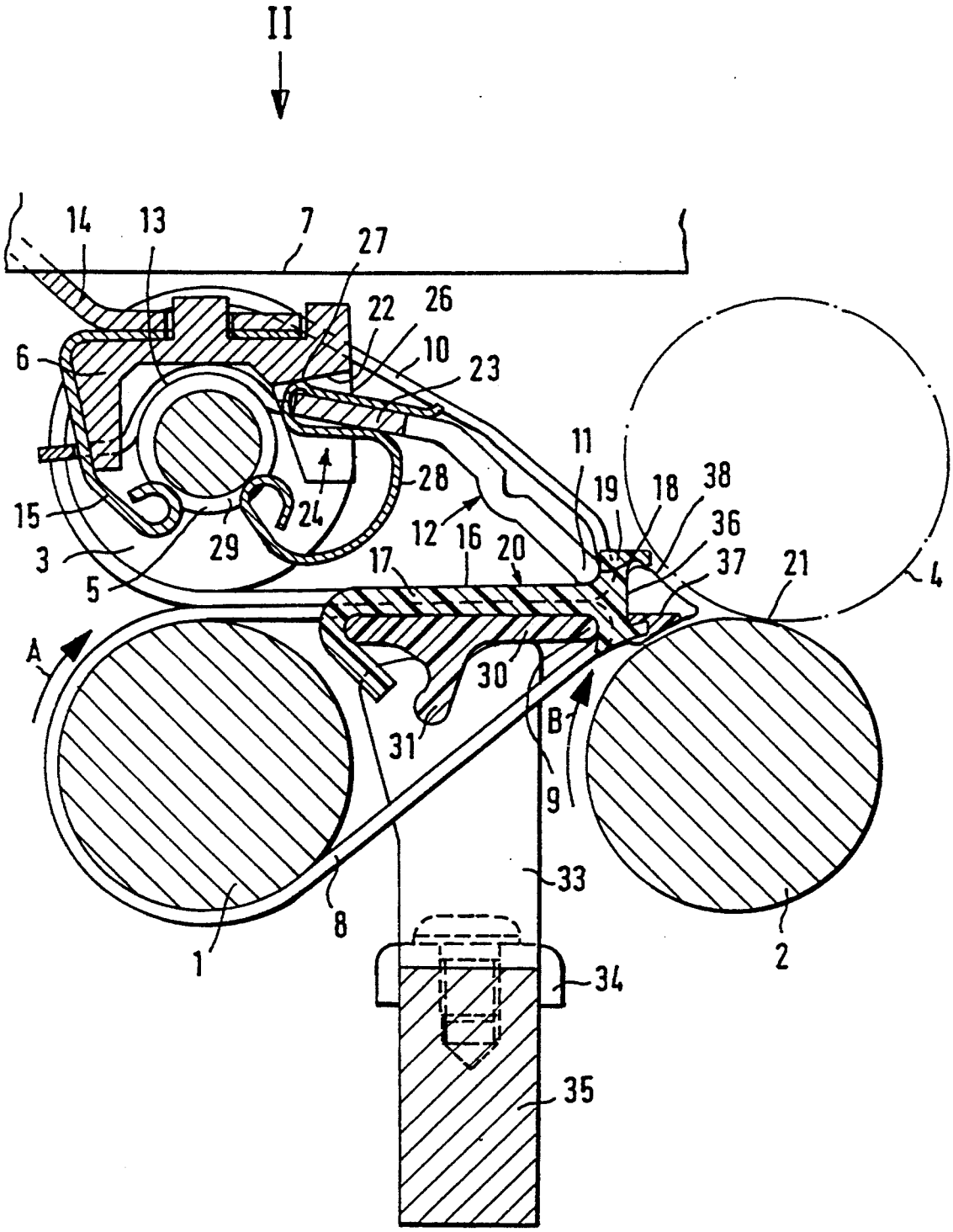
FIG. 1 is a sectional lateral view of a two-apron drafting unit according to the invention along the sectional plane I—I of FIG. 2.
Figure 2:
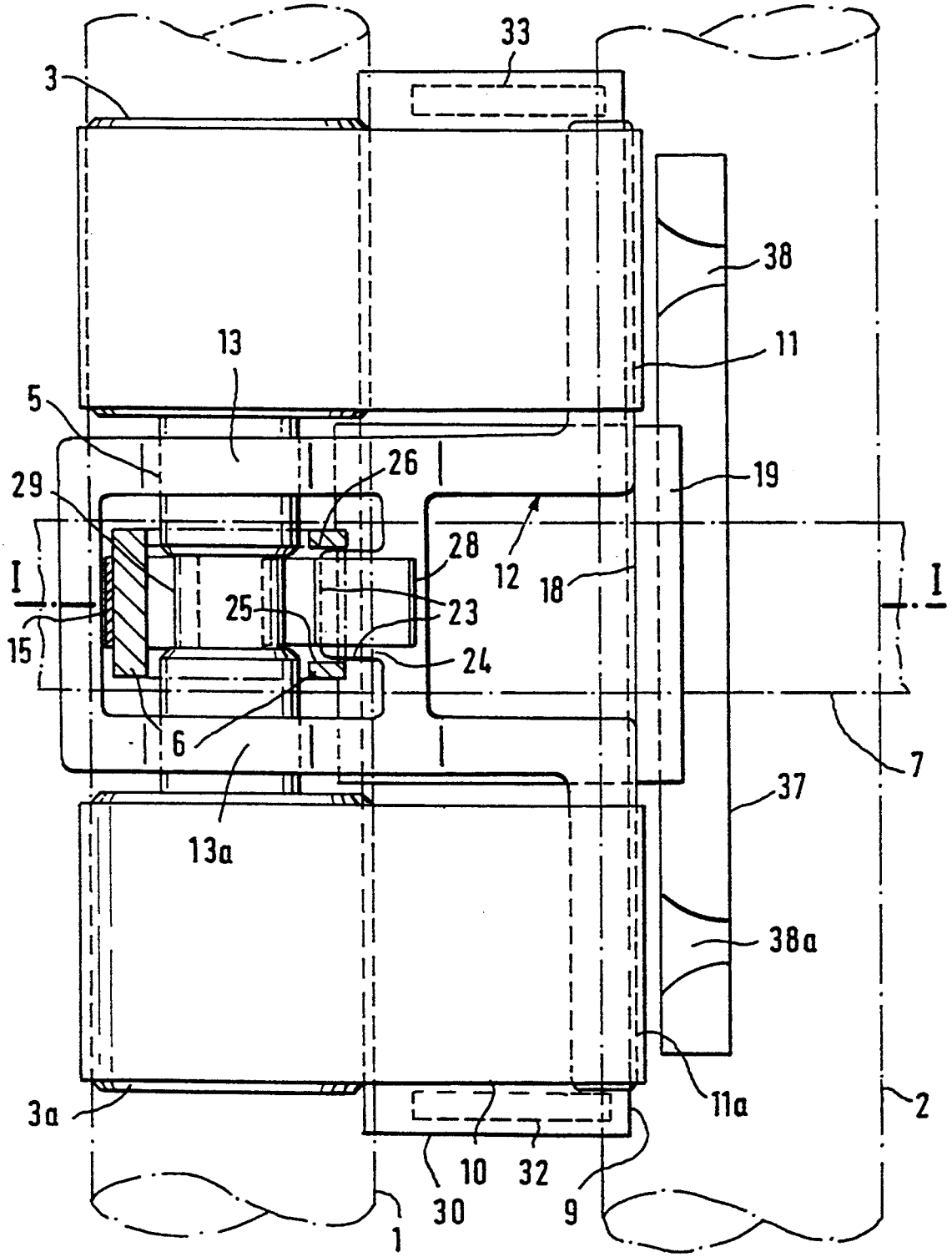
FIG. 2 is a view in the direction of the arrow II of FIG. 1, in which case some components were left out for reasons of representation and some components where represented in a sectional view.
Figure 3:
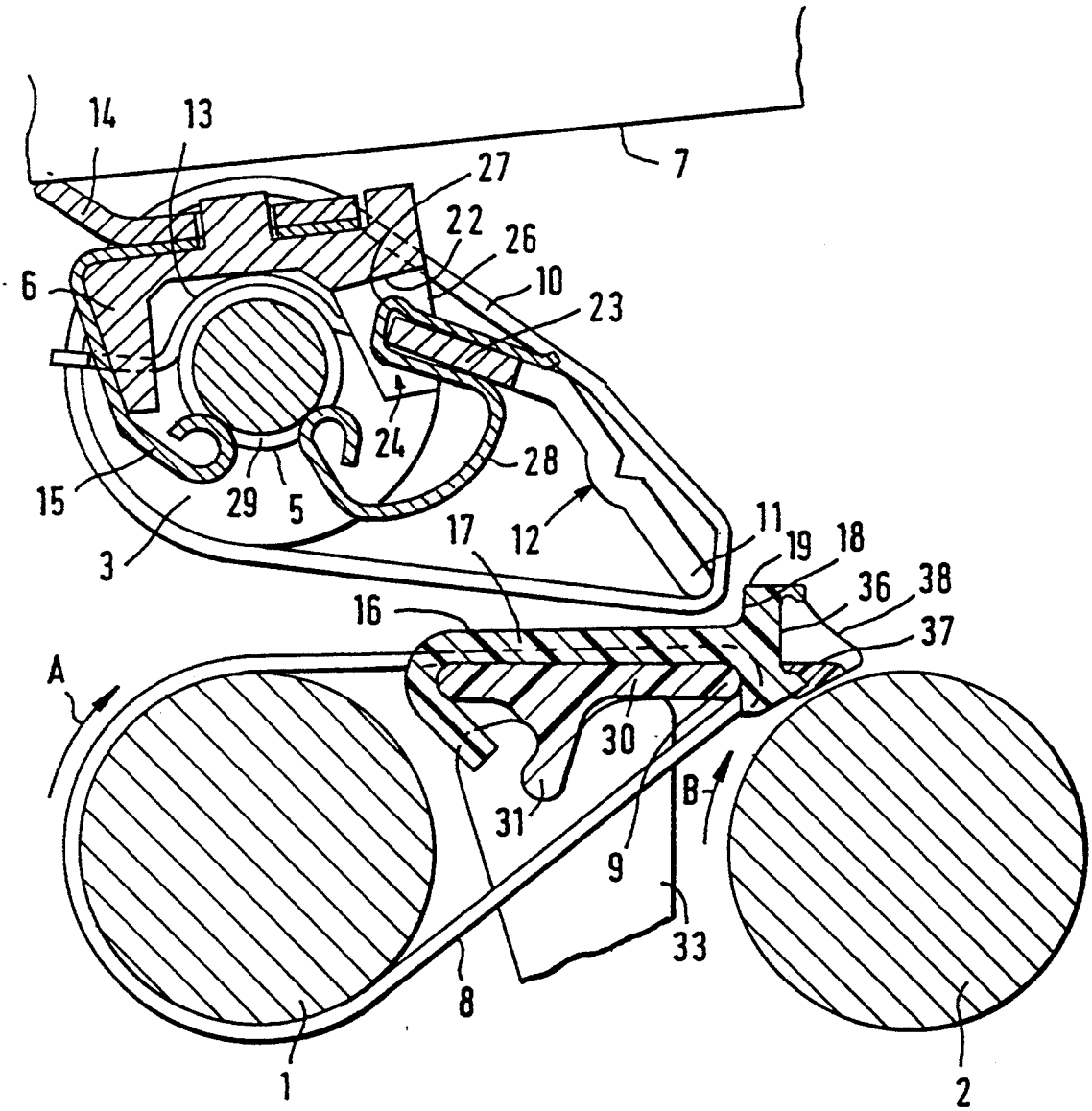
FIG. 3 is a view of the two-apron drafting unit according to FIG. 1 when the pressure roller twin is lifted off the bottom cylinder.

In FIGS. 1, 2 and 3, the two-apron drafting unit according to the invention is shown only as a cut-out. Two bottom cylinders 1 and 2 are visible which are driven in the directions of the arrows A and B, extend in the longitudinal direction of the machine and to which spring loaded pressure rollers 3 and 4 are assigned. In addition to the two illustrated roller pairs 1, 3 and 2, 4, the two-apron drafting unit has at least one other roller pair. The pressure rollers 3 and 4 are connected with pressure rollers of adjacent spinning stations to form so-called pressure roller twins, as illustrated in FIG. 2 by means of the adjacent pressure rollers 3 and 3*a*, which are connected with one another by means of a common shaft 5. This basic arrangement is known to the person skilled in the art and does not have to be described here in detail.

The individual pressure roller pairs are each held in a pressure roller holder 6 which is carried on a load carrier 7 which can be swivelled away from the bottom cylinders 1 and 2 and is only outlined. The arrangement of the pressure roller holders 6 in a load carrier 7 is also known to a person skilled in the art, as indicated, for example, in the German Published Patent Application DE 38 23 872 A1. The load carriers 7 and the pressure roller holders 6, which are holding them, are arranged in the center with respect to the pressure roller twins.

The bottom cylinder 1, which in a customary three-cylinder drafting unit is the central bottom cylinder of three bottom cylinders, is surrounded by a wound-around bottom apron 8. In the area of the bottom cylinder 2 which follows, the so-called delivery cylinder, the bottom apron 8 is guided around a lower deflection guide 9 which, in a known manner, may be constructed as a so-called reversing rail which reaches over at least two-spinning stations. In a corresponding manner, the pressure roller 3—like the other pressure roller 3*a* of the pressure roller twin—is surrounded by a wound-around top apron 10 which, in addition, is guided in the area of the pressure roller 4 around an upper deflection guide 11. The upper deflection guide 11 of both spinning stations assigned to the pressure roller twin is a component of the so-called apron cradle 12.

The apron cradle 12, which reaches over two spinning stations and which is therefore constructed as a twin cradle, rests with half-shell-shaped guides 13 and 13*a* in direct proximity of the pressure rollers 3 and 3*a* on the shaft 5 of the pressure roller twin and therefore, at the same time, guides the pressure roller twin. After an interruption of the operation in which the pressure roller 3 and, together with it, the apron cradle 12, may take up the position illustrated in FIG. 3, in which the pressure roller 3, and together with it the apron cradle 12, may take up the position illustrated in FIG. 3, in which the pressure roller twin is lifted off the bottom cylinder 1, pressure rollers 3 and 3*a*, together with the apron cradle 12, must be returned into the operating position according to FIG. 1, specifically when the two-apron drafting unit is closed in the known manner by the lowering of the load carrier 7. The requirement exists in this case to align in parallel the pressure roller twin, which contains the pressure rollers 3 and 3*a*, together with the apron cradle 12, precisely with respect to the lower deflection guide 9 and thus with respect to the bottom cylinders 1. This takes place by means of the characteristics according to the invention which will be described in the following.

The found improvement is based on the fact that the pressure roller holder 6 is provided essentially only with the function of providing the load by means of the loading spring 14. The parallel alignment of the pertaining pressure roller twin, on the other hand, is not taken over by the pressure roller holder 6. To a very significant extent, the fact contributes to this purpose that the shaft 5 of the pressure roller twin is unguided in the radial direction in the pressure roller holder 6. As illustrated particularly in FIGS. 1 and 3, the pressure roller holder 6 surrounds the shaft 5 at a clear distance.

So that, when the two-apron drafting unit is opened according to FIG. 3, the shaft 5 does not fall off the pressure roller holder, a securing spring 15 is arranged on it which, when the load carrier 7 is opened, holds the shaft 5 in the pressure roller holder 6. This securing spring 15 has the effect that, when the pressure roller twin is lifted off, the pressure rollers 3 and 3*a*, including the apron cradle 12, cannot fall out of the pressure roller holder 6. It is not important in this case that, when the two-apron drafting unit is open, the pressure roller twin can rock back and forth. When the load carrier 7 is opened, a very rough and imprecise guiding will be sufficient. It is only when the two-apron drafting unit is closed that the apron cradle 12 resumes a position that is defined and correct with respect to the technology of spinning, as will be described in the following.

During the closing of the two-apron drafting unit, the upper deflection guide 11 of the apron cradle 12 slides toward the front on a stop face 16 of a stop 17, specifically to another stop face 18 of another stop 19. In this case, the two stops 17 and 19 are part of a common component 20 made of plastic on which the stop faces 16 and 18 are mounted in an L-shape essentially at a right angle with respect to one another.

The stop face 16 defines the distance by which the upper deflection guide 11 is away from the lower deflection guide 9, which is the so-called opening width. In contrast, stop face 18 is used essentially for the parallel alignment of the apron cradle 12 and thus of the pertaining pressure roller twin and, in addition, defines the distance of the upper deflection guide 11 from the nip line 21 of the roller pair 2, 4 which follows.

It is important that the stop face 18 has a wide guiding base which is suitable for aligning the apron cradle 12 in parallel with respect to the lower deflection guide 9 and thus to the bottom cylinder 1. Therefore, —see FIG. 2—the stop 19 must reach into the direct proximity of the pressure rollers 3 and 3*a*.

Because of the fact that the shaft 5 of the pressure roller twin is unguided in the radial direction in the pressure roller holder 6, the apron cradle 12 can be pressed against the stop 19 without play and without the requirement of having to also move the pressure roller holder 6. This takes place because of the fact that the loading force of the loading spring 14 arranged on the pressure roller 6 presses by means of an oblique surface 22 against the apron cradle 12, whereby the apron cradle 12 is pressed against the stops 17 and 19. As mentioned above, the apron cradle 12 itself rests by means of half-shell-shaped guides 13 and 13*a* on the shaft 5, whereby the shaft of the pressure roller twin is loaded against the pertaining bottom cylinder 1.

As illustrated particularly in FIG. 2, the upper deflection guide 11 is a two-armed construction and has a nose 23 which is situated in the center between the two arms. This nose 23 of the apron cradle 12 projects into a frontal recess 24 of the pressure roller holder 6. On the left and on the right adjacent to the nose 23, the pressure roller holder 6 exhibits lateral guiding surfaces 25 and 26 which limit the mobility of the apron cradle 12 in the lateral direction. The loading oblique surface 22 presses on a hump 27 of a spring 28 which reaches around the nose 23 and which, in turn, engages in a groove 29 of the shaft 5 of the pressure roller twin. Thus, the pressure roller twin is also secured in the lateral direction because the pressure roller holder 6 guides the apron cradle 12 laterally and because the apron cradle, in turn, guides the shaft 5 laterally by way of the spring 28. The spring 28 has the task of holding the apron cradle 12 together with the pressure roller twin in the demounted condition, and is without function during the operation.

The bump 27 of the spring 28 has the purpose of defining the load transmission. The force of the loading spring 14 is divided into several components which, on the one hand, act against the stops 17 and 19 and, on the other hand, act against the shaft 5. Thus, the loading force is transmitted without play against the stops 17 and 19 by means of which the pressure roller twin is aligned in parallel with respect to the bottom cylinder 1 without the requirement of moving the pressure roller holder in the direction of the stops 17 and 19.

The component 20, which contains the stops 17 and 19, is clipped onto a longitudinal rail 30 which is also constructed of plastic. In a manner not shown here, a button may be provided in the center between two spinning stations which guides the component 20 in the longitudinal direction of the machine. In this case, a tab 31 of the longitudinal rail 30 engages in holding devices 32 and 33 which have U-shaped bows 34 which are screwed onto a longitudinal rail 35 fixed to the machine. If necessary, these longitudinal rails 35 may be arranged in a vertically adjustable manner so that the lower deflection guides 9 will be adjustable in their vertical position with respect to the drafting zone plane.

The function of the tab 31 is the swivelling-up of the rails 30 when laps are formed on the bottom cylinder 2, as described in the older German Patent Application P 41 22 881.2, which is no prior publication.

In the area of the nip line 21, the component 20 has a dovetailed groove 36 which carries an exchangeable strip 37 with sliver guides 38. The latter have a V-shaped construction and have recesses which are open toward the top and through which the fiber flow travels.

FIGS. 4, 5, 6 and 7, which will be described in the following, illustrate alternative constructions of the stops 17 and 19 of FIG. 1.

Figure 4:
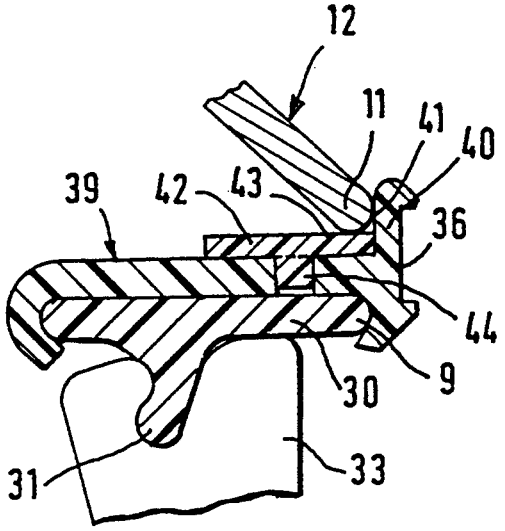
FIG. 4 to 7 are views of different developments of the L-shaped stop faces.

In the case of the development according to FIG. 4, a component 39 is clipped onto a rail 30 which extends along several spinning stations and contains the lower deflection guide 9 connected with this component 39. The other stop 42, whose stop face 43 is used for determining the distance between the upper deflection guide 11 and the lower deflection guide 9, is clipped by means of pin-type projection 44 into a corresponding bore of the component 39. This renders the stop 42, which determines the opening width, exchangeable. In addition, the component 39 with the stop 40 can be removed from the strip 30 and can be replaced by another component.

Reference numbers of FIG. 4 or one of the figures that follow, to the extent that they were already described by means of FIGS. 1 to 3, will no be explained again here or in the following.

Figure 5:
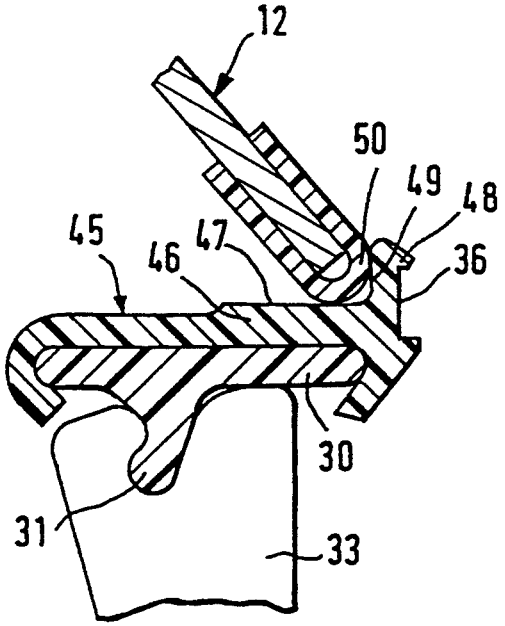

According to FIG. 5, the component 45 itself, which is clipped onto the strip 30, is the stop 46 which contains the stop face 47 for the spacing. The component 45 also contains the stop 48 with the stop face 49 for the parallel alignment. The stop faces 47 and 49 are assigned to one another in an L-shape in the manner described above.

In the case of this embodiment, the adjustment of the opening width takes place by means of an enveloping piece which forms the upper deflection guide 50 and is exchangeably fastened on the apron cradle 12. If the opening width is to be changed, a different enveloping piece will be used.

Figure 6:
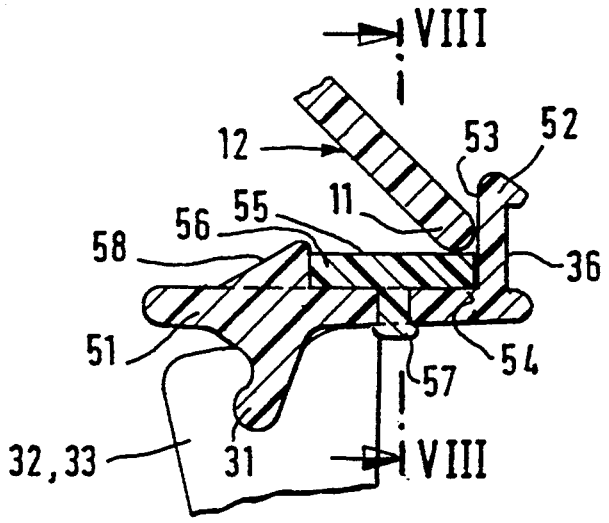

FIG. 6 illustrates a further preferred embodiment. In this case, the strip 51 itself, which preferably extends along two spinning stations and is fastened to the holders 32 and 33, contains the stop 52 which, by meads of its stop face 53, is used for the parallel alignment of the upper deflection guides 11 and thus of 54. A fiber-glass-reinforced plastic material may advantageously be used as the strip 51 constructed as a preform. In the center area between the pressure rollers 3 and 3*a*, the rail 51 has the stop faces 53 for the apron cradle 12. The bottom aprons, which are not shown, extend around the lower deflection guide 54 which is constructed as a rounded edge.

The upper deflection guide 11 will also rest against a stop face 55 of another stop 56 which is constructed as a plastic plate and is clipped into a corresponding bore of the strip 51 by means of a pin-type lengthening 57. The stop 56 is therefore exchangeable. In a manner that will be described in the following, the removal may take place by means of special tongs. The stop faces 53 and 55 are arranged in an L-shape with respect to one another in the manner described above.

When the load carrier 7 of the two-apron drafting unit is closed, the upper deflection guides 11 can find their correct position on the stop faces 53 and 55 without any manual intervention. In order to ensure this, a wedge-type elevation 58 is a slide surface which leads the cradle 12 to the stops 53 and 55. In this case, the deflection guide 11 slides—in FIG. 6, from the left to the right—along the outer contour of the wedge-shaped elevation 58 and automatically finds its operating position.

If the upper deflection guide 11 is made of plastic, it is expedient to reinforce the hump 27 (see FIG. 1) to which the oblique surface 22 of the pressure roller holder 6 is applied. This may take place by means of small spring plates or the like, so that no damaging wear takes place at this point.

The above-described dovetailed groove 36 here also has the purpose of receiving and securing a sliver guide which may be required for spinning.

According to FIG. 6, there is therefore a strip 51 which contains the lower deflection guides 54 and which has one or several stop faces 53 used for the parallel alignment. The stop 56 which is used for determining the distance is used as a spacer in this rail 51. The rail 51 preferably extends along two spinning stations and, if necessary, may be removed from a carrier rail which extends continuously underneath it. The strip 51 may be provided with lateral guides for the bottom aprons, which is also the case in a manner that is known shown on the apron cradle 12 for the top aprons. Finally, the strip 51 has receiving devices 36 for required sliver guides.

Figure 7:
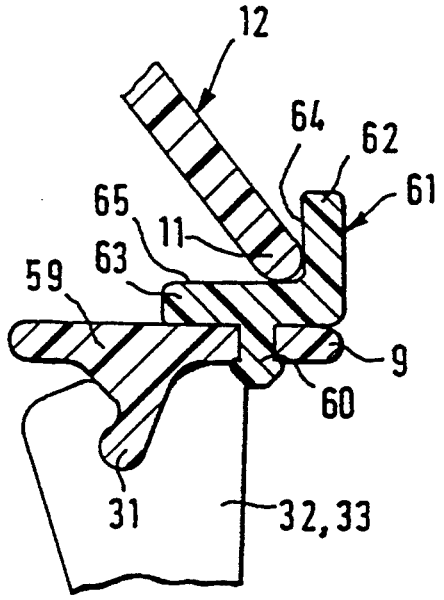

In the embodiment according to FIG. 7, a pin 60 of a component 61 which has an L-shaped cross-section is clipped into a bore of a strip 59 extending along two spinning stations. If necessary, several components 61 may be provided next to one another so that a guiding base for the apron cradle 12 is provided next to one another so that a guiding base for the apron cradle 12 is provided which is as wide as possible. Component 61 therefore at the same time comprises the stops 62 and 63 with their stop faces 64 and 65. In this case, stop face 64 is used for the parallel alignment of the apron cradle 12 and stop face 65 is used for determining the distance between the upper deflection guide 11 and the lower deflection guide 9.

Figure 8:
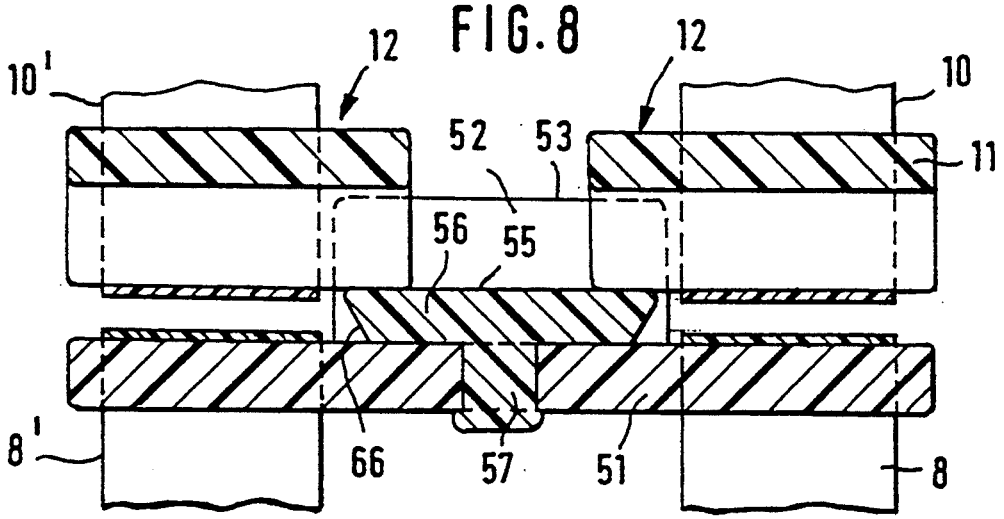
FIGS. 8 is a sectional view along the sectional plane VIII—VIII of FIG. 6.

FIG. 8, which is part of FIG. 6, is a rear view of the stops 52 and 56 as well as their stop faces 53 and 55. Stop 56 for determining the distance of the upper deflection guide 11 from the lower deflection guide, which is not visible in FIG. 8, has lateral surfaces 66 which—starting out from stop face 55—form a type of undercut in the direction of the strip 51. Thus, special tongs may be applied to the lateral surfaces 66 when stop 56 is to be exchanged for another stop. As an alternative, it is naturally possible to clip stop 56 into stop 52.

FIG. 8 shows that all stop faces 53 and 55 are situated between the top aprons 10 and 10'. However, stops 52 and 56 must be so wide that they reach almost to the top aprons 10, 10' so that a guiding base which is as wide as possible is achieved for the parallel alignment.

Figure 9:
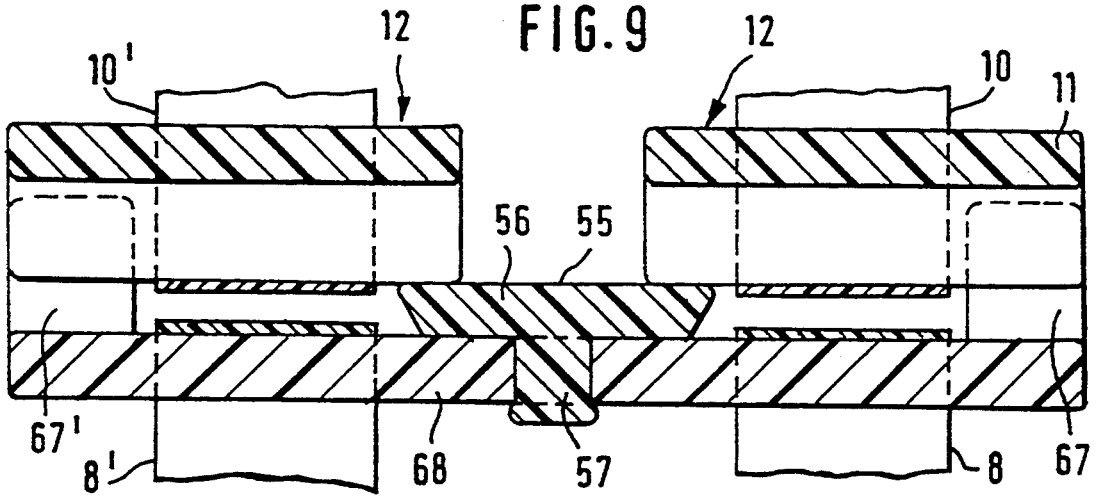
FIGS. 9 and 10 are sectional views of other embodiments similar to FIG. 8.

FIG. 9 shows a variant in which the stop 56, whose stop face determines the distance between the upper deflection guide 11 and the lower deflection guide, is physically separated from the other stop 67, 67' which is used for the parallel alignment. It is shown that stop 67, 67' comprises two partial stops which—deviating from the previously described embodiments—are arranged outside the top aprons 10, 10'. In this manner, a guiding base which is a wide as possible can be provided for the stops 67 and 67' used for the parallel alignment, which, however, is possible only in the case of a fairly large spacing of the spinning stations, in the case of which a slightly wider strip 68 may be used.

Figure 10:
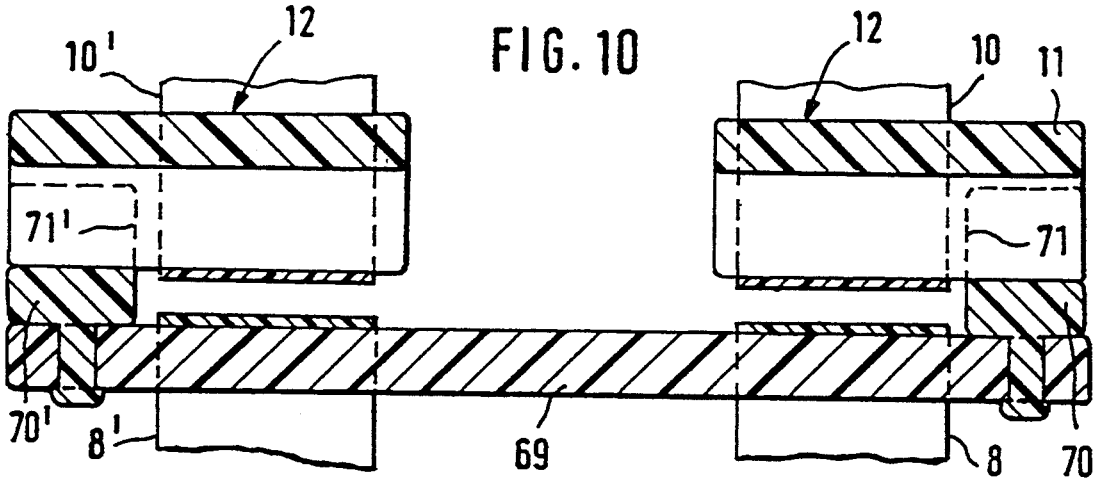

FIG. 10 finally shows a widened strip 69 which reaches over two spinning stations and in the case of which both stops 70 and 71 or 70' and 71' were in each case displaced outside the top aprons 10, 10'. On the one hand, this improves the parallel alignment and, on the other hand, has the advantage that the determination of the distance between the upper deflection guide 11 and the lower deflection guide also becomes more precise.

In the embodiments which will be described in the following, structural elements which corresponding to those of FIG. 1 are provided with the same reference numbers as in FIG. 1. These components will therefore not be described again.

Figure 11:
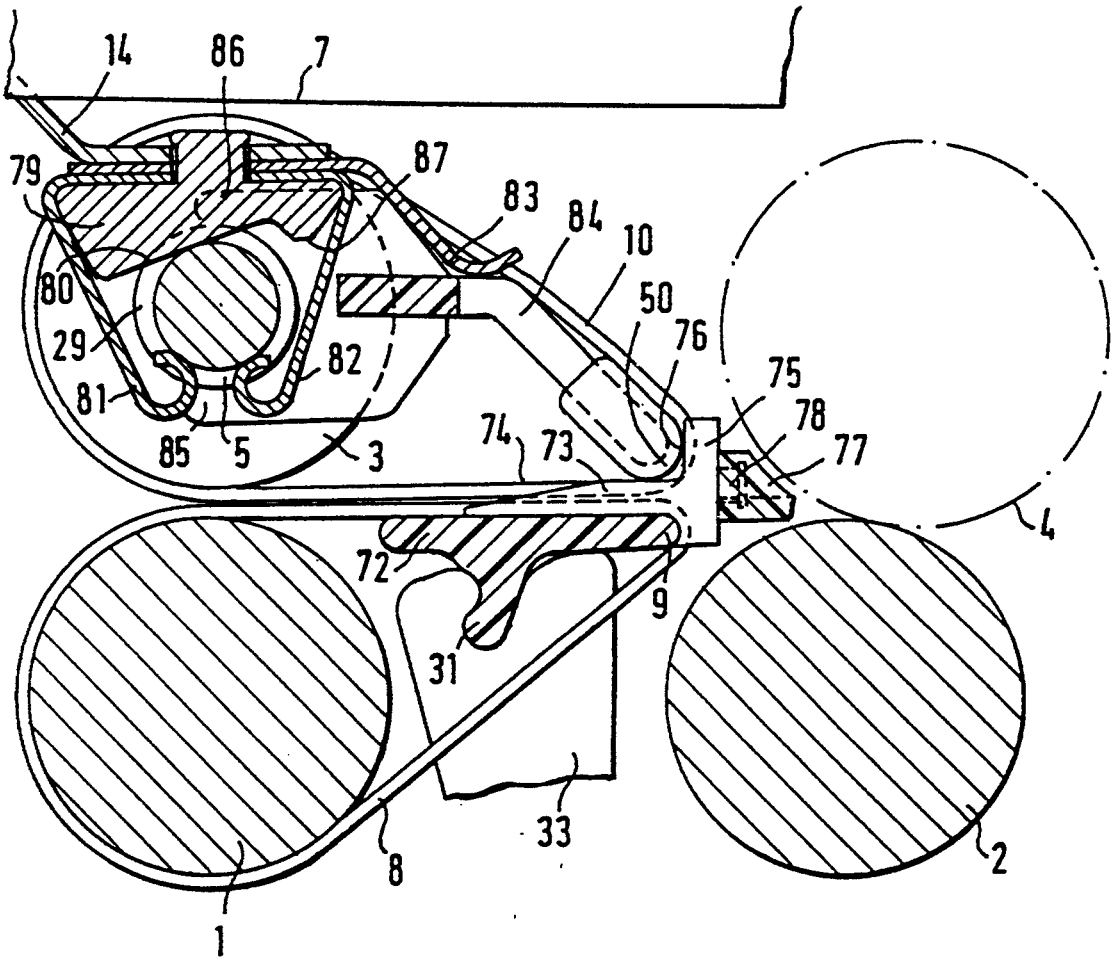
FIG. 11 is a view similar to FIG. 1, showing another embodiment in which the loading spring presses directly against the shaft of the pressure roller twin.

In the case of the embodiment according to FIG. 11, a pressure roller holder 79 is provided which, by means of a force introducing surface 80 directed diagonally against the stops 73 and 75' directly loads the central area of the shaft 5 of the pressure roller twin. The diagonal force introducing surface 80 causes a small thrust of the apron cradle 84 against the roller pair 2, 4. This thrust is not impaired by the weak securing springs 81 and 82 so that, also in this case, the pressure roller twin is radially unguided in the pressure roller holder 79. The securing springs 81 and 82 only have the purpose of keeping the pressure roller twin connected with the load carrier 7 when the load carrier has swung open.

An additional hold-down spring 83, which is mounted on the pressure roller holder 79, presses the apron cradle 84 slightly downward so that, already when the load carrier 7 is closed, it arrives with its upper deflection guide 50 securely at the stop faces 74 and 76 of the stops 73 and 75.

The apron cradle 84 is preferably made of plastic and is provided in the area of its upper deflection guide 50 with a covering which is also made plastic and by means of which the so-called opening width is adjusted. The apron cradle 84 envelopes the front side of the large diameter of the shaft 5 of the pressure roller twin. As a result of the thrust in the direction of the roller pair 2, 4, no play will exist between the apron cradle 84 and the shaft 5 of the pressure roller twin. By means of its arms 85 and 86, the apron cradle 84 surrounds the shaft 5 in such a manner that both parts, even if they are removed from the drafting unit, remain connected with one another. The shaft 5 is clipped into the enveloping radius of the arms 85 and 86. This is possible in the case of plastic which is sufficiently elastic. The loading spring 14, the hold-down spring 83 as well as the securing springs 81 and 82 are jointly riveted to the pressure roller holder 79. Thus, only one operation is necessary for the mounting of these springs.

In the forward area, the pressure roller holder is additionally provided with hump-type nose 87 which is used for the additional securing of the shaft 5 in the pressure roller holder 79.

Figure 12:
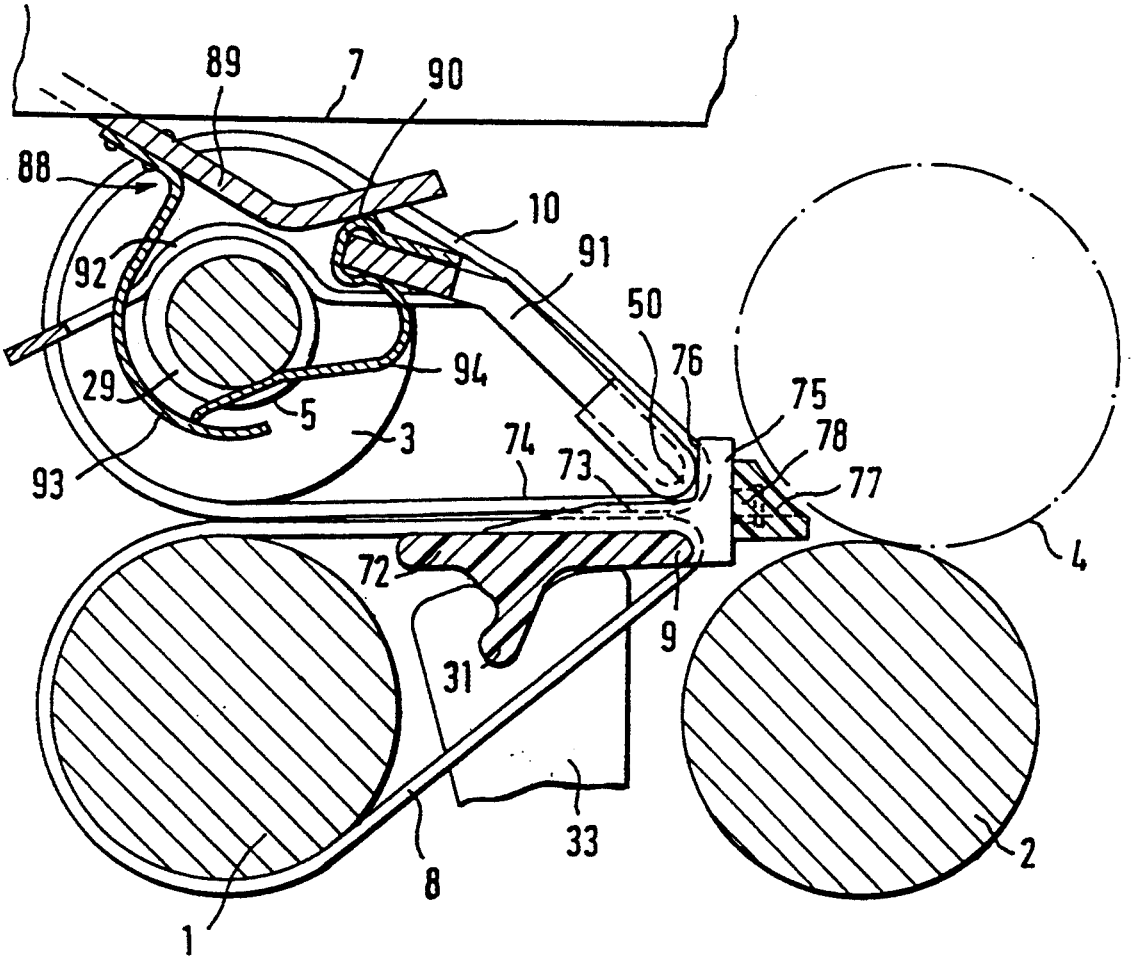
FIG. 12 is a view similar to FIG. 1, showing another embodiment in which the loading spring presses directly against the apron cradle.

In the case of the embodiment according to FIG. 12, the pressure roller holder 88 essentially comprises only the loading spring 89 and a leaf-spring-type securing element 93. The loading spring 89 presses directly onto a nose 90 of the apron cradle 91 or onto a securing spring 94 which is connected with it, engages in a recess 29 of the shaft 5 of the pressure roller pair, and secures the apron cradle 91 with respect to an axial displacement. In the case of this embodiment, the loading is therefore such that first the apron cradle 91 is loaded, and this apron cradle 91, by way of the arms 92, transmits the loading to the shaft 5 of the pressure roller twin.

The securing element 93 has no function during the spinning. It secures only the pressure roller twin together with the apron cradle 91 when the load carrier 7 is swivelled upward.

The securing spring 94 has the purpose of holding the apron cradle 91 together with the pressure roller twin, specifically only when it is demounted. The securing spring 94 also has no function during the spinning.

Figure 13:
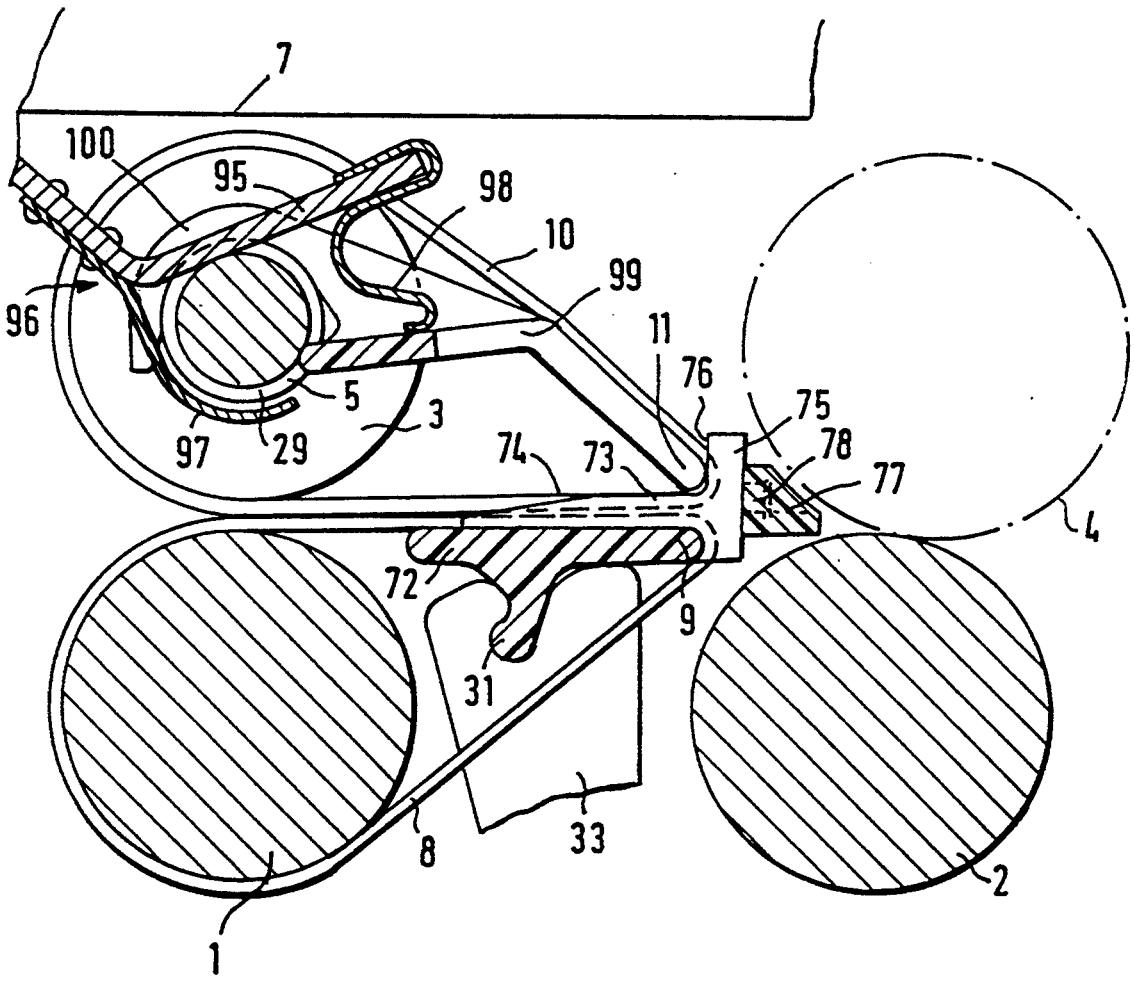
FIG. 13 is a view similar to FIG. 12, showing another embodiment in which the loading spring presses directly against shaft of the pressure roller twin.

In the case of the embodiment according to FIG. 13, the pressure roller holder 96 again essentially comprises the loading spring 95 and the securing spring 97, in which case also here the shaft 5 of the pressure roller twin is unguided in the radial direction in the pressure roller holder 96. The loading spring 95 acts directly onto the shaft 5 of the pressure roller twin. The securing spring 97 reaches around the shaft 5 of the pressure roller twin with play so that the pressure roller twin is secured when the load carrier 7 is swung open. The additional securing spring 98, which is mounted on the loading spring 95 provides that the pressure roller twin and the apron cradle 99 remain together after the demounting.

The arms 100 of the apron cradle 99 provide also here that the shaft 5 of the pressure roller twin is aligned in parallel with respect to the stops 73 and 75 and thus, since the stops 73 and 75 are situated in parallel to the bottom cylinder 1, is aligned also with respect to it.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A multiple-apron drafting unit for spinning machines comprising:

at least one drivable bottom cylinder, a bottom apron arrangement surrounding the at least one bottom cylinder, a pressure roller twin arrangement including a pressure roller shaft with a pair of pressure rollers, top aprons surrounding each of the pressure rollers, a movable load carrier operably arranged to carry the pressure roller shaft and associated pressure rollers and top aprons for movement between an open non-operating position and a closed operating position with the top aprons and bottom apron arrangement defining sliver drafting paths therebetween, a top apron cradle for guiding the top aprons, said top apron cradle including upper deflecting guides for the top aprons, a lower deflecting guide arrangement for guiding the bottom apron arrangement, stops with first and second stop faces aligned with the lower deflecting guide arrangement, and a spring arrangement for positioning the upper deflecting guides of the top apron cradle by contact pressure against the first and second stop faces such that the first stop face determines the distance between the upper and lower deflecting guides and the second stop face serves for the parallel alignment of the upper and lower deflecting guides when the load carrier is moved to the closed operating position, wherein the pressure roller shaft is held in a pressure roller holder carried by the load carrier with the pressure roller shaft being unguided in the radial direction in the pressure roller holder such that a pressure roller holder moves independently of the top apron cradle in the movements against the first and second stop faces.

2. A multi-apron drafting unit according to claim 1, wherein the pressure roller twin arrangement is pressed against an associated bottom cylinder by means of the top apron cradle.

3. A multi-apron drafting unit according to claim 1, wherein the pressure roller holder is spring loaded and applied to the top apron cradle by means of a force introducing surface which generates a force component against both stop faces.

4. A multi-apron drafting unit according to claim 3, wherein a loading spring of the pressure roller holder directly loads the top apron cradle.

5. A multi-apron drafting unit according to claim 1, wherein the pressure roller holder directly loads the pressure roller shaft by means of a force introducing surface.

6. A multi-apron drafting unit according to claim 5, wherein a loading spring of the pressure roller holder directly loads the pressure roller shaft.

7. A multi-apron drafting unit according to claim 5, wherein an additional spring is provided for the pressing-down of the top apron cradle.

8. A multi-apron drafting unit according to claim 1, wherein the pressure roller holder is provided with guiding surfaces which laterally guide the top apron cradle.

9. A multi-apron drafting unit according to claim 1, wherein at least one securing element, which secures the pressure roller shaft, is assigned to the pressure roller holder.

10. A multi-apron drafting unit according to claim 1, wherein the stops include at least two stops which each have a stop face, the stop faces changing into one another approximately in an L-shape.

11. A multi-apron drafting unit according to claim 1, wherein a sliding surface is assigned to the stop faces which leads the apron cradle to the stops.

12. A multi-apron drafting unit according to claim 1, wherein at least one of the stops is exchangeably mounted on the assigned lower deflection guide arrangement which is preferably constructed as a reversing rail.

13. A multi-apron drafting unit according to claim 1, wherein the lower deflection guide arrangement can be adjusted in position with respect to a drafting zone plane of the multi-apron drafting unit.

14. A multi-apron drafting unit according to claim 1, wherein the second stop, which is used for the parallel alignment, comprises two partial stops whose mutual distance corresponds approximately to a distance of the top aprons pertaining to a pressure roller twin.

15. A multi-apron drafting unit according to claim 1, wherein lateral guides for the bottom apron arrangement and the top aprons are assigned to at least one of the deflection guides.

16. A multi-apron drafting unit according to claim 1, wherein a holding device is assigned to the second stop which holds a sliver guide.

17. A multi-apron drafting unit according to claim 3, wherein the pressure roller holder is provided with guiding surfaces which laterally guide the top apron cradle.

18. A multi-apron drafting unit according to claim 7, wherein the pressure roller holder is provided with guiding surfaces which laterally guide the top apron cradle.

19. A multi-apron drafting unit according to claim 3, wherein at least one securing element, which secures the pressure roller shaft, is assigned to the pressure roller holder.

20. A multi-apron drafting unit according to claim 7, wherein at least one securing element, which secures the pressure roller shaft, is assigned to the pressure roller holder.

21. A multi-apron drafting unit according to claim 3, wherein the stops include at least two stops, which each have a stop face, the stop faces changing into one another approximately in an L-shape.

22. A multi-apron drafting unit according to claim 7, wherein the stops include at least two stops, which each have a stop face, the stop faces changing into one another approximately in an L-shape.

23. A multi-apron drafting unit according to claim 3, wherein at least one of the stops is exchangeably mounted on the assigned lower deflection guide arrangement which is preferably constructed as a reversing rail.

24. A multi-apron drafting unit according to claim 7, wherein at least one of the stops is exchangeably mounted on the assigned lower deflection guide arrangement which is preferably constructed as a reversing rail.

25. A multi-apron drafting unit according to claim 24, wherein the lower deflection guide arrangement is adjustable in position with respect to a drafting zone plane of the multi-apron drafting unit.

26. A multi-apron drafting unit according to claim 3, wherein a holding device is assigned to the second stop which holds a sliver guide.

* * * * *